US005411097A

United States Patent [19]

Manke et al.

[11] Patent Number: 5,411,097

[45] Date of Patent: May 2, 1995

[54] HIGH PRESSURE CONVERSION FOR CIRCULATING/SAFETY VALVE

[75] Inventors: Kevin R. Manke, Flower Mound; Paul Ringgenberg, Carrollton, both of Tex.

[73] Assignee: Halliburton Company, Houston, Tex.

[21] Appl. No.: 242,567

[22] Filed: May 13, 1994

[51] Int. Cl.[6] ..... E21B 34/10

[52] U.S. Cl. ..... 166/324; 166/328

[58] Field of Search ..... 166/319, 321, 334, 336, 166/317, 264

[56] References Cited

U.S. PATENT DOCUMENTS

| | | | |
|---|---|---|---|
| 4,058,165 | 11/1977 | Holden et al. | 166/314 |
| 4,270,610 | 6/1981 | Barrington | 166/317 |
| 4,311,197 | 1/1982 | Hushbeck | 166/373 |
| 4,347,900 | 9/1982 | Barrington | 166/334 X |
| 4,375,239 | 3/1983 | Barrington et al. | 166/336 |
| 4,378,850 | 4/1983 | Barrington | 166/321 X |
| 4,420,043 | 12/1983 | Brooks | 166/319 |
| 4,474,242 | 10/1984 | Upchurch | 166/323 |
| 4,529,038 | 7/1985 | Brieger | 166/312 |
| 4,553,598 | 11/1985 | Meek et al. | 166/321 X |
| 4,576,234 | 3/1986 | Upchurch | 166/319 |
| 4,610,308 | 9/1986 | Meek | 166/321 |
| 4,657,083 | 4/1987 | Ringgenberg | 166/374 |
| 4,691,779 | 9/1987 | McMahan et al. | 166/321 |

*Primary Examiner*—Ramon S. Britts
*Assistant Examiner*—Frank S. Tsay
*Attorney, Agent, or Firm*—Tracy W. Druce; Marchella D. Watkins

[57] ABSTRACT

A well testing tool for use in high pressure wells where it is desired to pressure test the equipment includes a mandrel that is ported to the interior of the test string. The ported mandrel allows pressure to equalize between the interior of the string and an annular chamber formed between the mandrel and the tool housing, and thereby eliminates the tendency of the mandrel to deform into the chamber.

15 Claims, 3 Drawing Sheets

HIGH PRESSURE CONVERSION FOR CIRCULATING/SAFETY VALVE

TECHNICAL FIELD OF THE INVENTION

This present invention relates generally to apparatus for testing a well, and more particularly, but not by way of limitation, to an improved mandrel assembly for an annulus pressure operated circulating/safety valve that is adapted for use in high pressure wells.

BACKGROUND OF THE INVENTION

When an oil or gas well is drilled, it is often desired to test the production capabilities of the subsurface formations intersected by the well by lowering a test string into the borehole to the formation depth. The formation fluid is then allowed to flow into the test string in a controlled testing program. It is further known to actuate one or more of the tools in the test string by increasing the well annulus pressure.

One annulus pressure operated testing tool that is commonly included in the test string is a combination safety and circulating valve. When actuated, a safety circulating valve closes in the formation by closing a closure valve, and simultaneously opens the string to fluid flow from the well annulus by opening a circulating port above the closure valve. Various valves of this nature are disclosed in U.S. Pat. Nos. 4,270,610, 4,311,197, 4,444,571, 4,691,779, and 4,657,083. Such devices may include sampling capability, through the use of pairs of spaced ball valves that trap a sample of the flowing fluid therebetween. In these tools, the ball valves themselves can be referred to as closure or safety valves, since they operate to shut off the flow of well fluid through the test string. Safety circulating valves typically include a cylindrical housing within which a concentric mandrel is driven from an first position to a second position upon actuation of the valve.

The valves disclosed in the patents cited above are referred to as atmospheric referenced tools because the differential area piston which drives the mandrel has a low pressure side exposed to substantially atmospheric pressure. In annulus pressure operated tools, the high pressure side of the piston is exposed to annulus pressure during operation. In each of the tools cited above, the low pressure side of the piston comprises a sealed chamber, created when the tool is assembled, which contains air at atmospheric pressure. Although that pressure may change due to heating or cooling after the tool is placed in a well, such changes are negligible for present purposes. An example of the low pressure chamber is shown at reference numeral 80 in FIG. 2B of U.S. Pat. No. 4,270,610.

When in use, the test string is subjected to pressure both inside the test string and in the well annulus. In the absence of additional applied pressure, both regions are subjected to hydrostatic pressure due to the weight of the drilling mud at the string depth. When it is desired to actuate an annulus pressure operated tool such as those described above, an additional pressure on the order of 1,000 to 5,000 psi is applied to the annulus. In an atmospheric referenced tool, the differential pressure that drives the mandrel is equal to the sum of the hydrostatic pressure and this applied annulus pressure. In most cases, the prior art tools will function satisfactorily under these conditions.

In certain high-pressure wells, however, it is also desired to test the integrity of the equipment under high pressure conditions by applying an increased pressure to the inside of the test string before starting the flow portion of the drill stem test. For example, such pressure tests can require applied pressure at the surface on the order of 10,000 to 20,000 psi. Because the total pressure inside the test string at the bottom of the well is equal to the sum of the applied pressure and the hydrostatic head, the pressure differential across the mandrel between the test string interior and the low pressure (atmospheric) chamber outside the mandrel can be as high as 35,000 psi.

While the prior art valves function satisfactorily when used in conventional wells wherein the pressure differential across the mandrel is always less than about 25,000 psi, it has been found that the higher differential that exists during high pressure equipment tests can result in permanent deformation of the mandrel. This is because the annular low pressure air chamber forms a large, unsupported area around the mandrel, into which the increased interior pressure tends to force the mandrel. With nothing to support it, the mandrel bulges radially outward. Deformation to this degree causes the metal of the mandrel to yield plastically, resulting in permanent deformation.

The consequences of this deformation may be severe, as the deformed mandrel cannot function as intended and may be completely immobilized relative to the housing. If the mandrel cannot slide longitudinally as intended, the ability to operate the closure and circulating valves is lost. More importantly, the ability of the tool to operate as a safety valve is compromised. Hence, a safety/circulating valve is desired that is not rendered inoperable by high pressure test conditions.

SUMMARY OF THE INVENTION

The present invention comprises a safety circulating valve adapted to avoid deformation of the mandrel during high pressure equipment tests. According to the present invention, the sealed annular low pressure chamber surrounding the mandrel is ported and allowed to equilibrate with the pressure inside the string. Instead of using the difference between annulus and atmospheric pressure to drive the mandrel, the present tool uses the difference between annulus and interior pressure. This pressure difference applied longitudinally across a shoulder on the mandrel causes a piston effect that drives the mandrel into a formation closing position. The same applied pressure that is used to actuate the valve is sufficient to drive the mandrel to the closed position. As the mandrel moves to its closed position, the chamber surrounding the mandrel collapses and the fluid in the chamber is forced out through the ports.

BRIEF DESCRIPTION OF THE DRAWINGS

Numerous features and advantages of the present invention will be apparent to those skilled in the art upon a reading of the following detailed description in combination with the accompanying drawings, wherein.

DETAILED DESCRIPTION OF A PREFERRED EMBODIMENT

During the course of drilling an oil well, the borehole is filled with a fluid known as drilling fluid or drilling mud. One of the purposes of this drilling fluid is to contain the hydrocarbons under pressure in the production zone intersected by the borehole. To contain these formation fluids, the drilling mud is weighted with various additives so that the hydrostatic pressure of the mud at the depth of the production zone is sufficient to maintain the formation fluid within the production zone of the formation without allowing it to flow to the surface through the borehole.

When it is desired to test the production capabilities of the production zone, a testing string is lowered into the borehole to the depth of the production zone and the formation fluid is allowed to flow into the flow bore of the string under the controlled conditions of a testing program. Under the conditions of a High Pressure well, it is common to run the string either open-ended or with a valve that allows the string to automatically fill while running in. When the testing depth has been reached and all the require testing string tubing or drill pipe and surface pressure control equipment are installed, a downhole valve is closed to allow for pressure testing the testing string to assure integrity. After a successful pressure test, the packer is set to seal the annulus formed between the testing string and the borehole, thus closing in the production zone from the hydrostatic pressure of the drilling fluid in the annulus. The drilling mud is then displaced by a lighter weight fluid so that the well can flow against the lower pressure.

The valve at the lower end of the testing string is then opened and the formation fluid, free from the restraining pressure of the drilling fluid, flows into the flowbore of the testing string.

Figure 1:
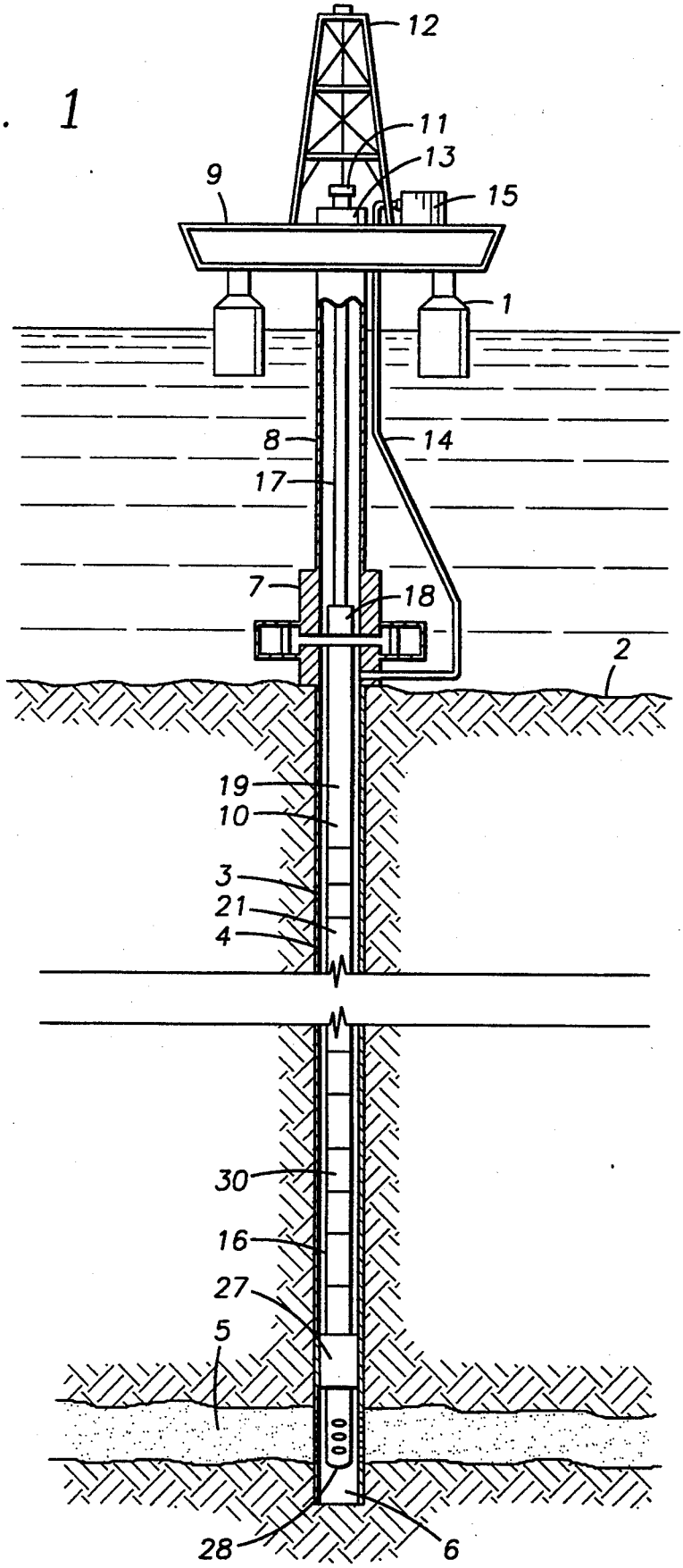
FIG. 1 is a schematic elevation view of a typical well testing apparatus using the present invention.

By way of example, a typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a subterranean production zone 5 in the formation. The casing string 4 includes a plurality of perforations at its lower end which extend into the formation 5 and provide communication between the formation 5 and the interior flowbore 6 of casing string 4.

At the submerged well site is located the well head installation 7 which includes blowout preventer mechanisms. A marine conductor 8 extends from the well head installation to the floating work station 1. The floating work station 1 includes a work deck 9 which supports a derrick 12. The derrick 12 supports a hoisting means 11. A well head closure 13 is provided at the upper end of the marine conductor 8. The well head closure 13 allows for lowering into the marine conductor and into the flowbore 6 of casing string 4 a formation testing string 10 which is raised and lowered into the well by hoisting means 11.

A supply conduit 14 is provided which extends from a hydraulic pump 15 on the deck 9 of the floating station 1 and extends to the well head installation 7 at a point below the blowout preventers to allow the pressurizing of the well annulus 16 formed between the test string 10 and casing string 4.

The testing string 10 includes an upper conduit string portion 17 extending from the work site 1 to the well head installation 7. A hydraulically operated conduit string test tree 18 is located at the end of the upper conduit string 17 and is landed in the well head installation 7 to thus support the lower portion 19 of the formation testing string 10. The lower portion 19 of the formation test string 10 extends from the test tree 18 to the formation 5. A packer 27 isolates the production zone 5 from the drilling fluids in the well annulus 16 above the packer 27. A perforated tail piece 28 is provided at the lower end of the test string 10 to allow fluid communication between the production zone 5 and the interior flowbore 21 of the tubular formation test string 10. The high pressure safety circulating valve 30 of the present invention is typically located near the lower end of the test string 10.

Figure 2A:
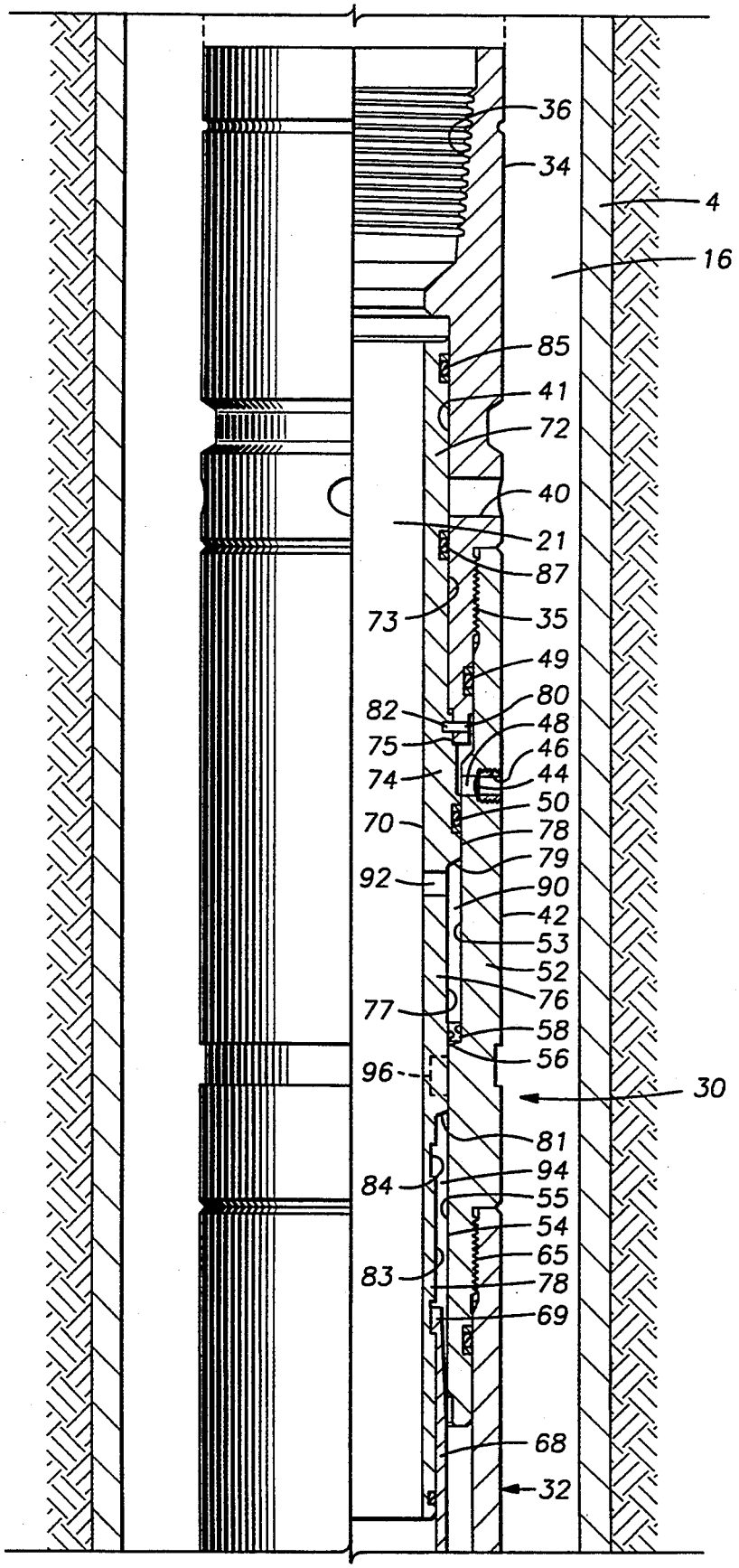
FIGS. 2A–B are a right side only cross sectional view of the present invention with the closure valve in the open position and the circulation valve closed.

Referring now to FIG. 2, high pressure safety circulating valve apparatus 30 of the present invention comprises a cylindrical outer housing generally designated by the numeral 32, which includes a top coupling 34, a rupture member 42, a closure member 60 and a lower housing adapter 38. A mandrel 70 is supported within housing 32. Top coupling 34 is located at the upper end of housing 32 and lower housing adapter 38 is located at its lower end. Top coupling 34 includes internal threads 36 for attaching apparatus 30 to that portion of test string 10 located above the apparatus 30, while lower housing adapter 38 includes external threads 39 for connection of apparatus 30 to that portion of test string 10 located below apparatus 30.

A circulating port 40 extends through top coupling 34 of housing 32 below threads 36. When port 40 is opened by moving mandrel 70 to its lowermost position, it allows communication and fluid flow between the flowbore 21 of the test string 10 and the well annulus 16. In FIG. 2, port 40 is shown closed with mandrel 70 blocking fluid flow therethrough. Seal members 85, 87, such as O-rings, are disposed in annular grooves around the upper end of mandrel 70 to sealingly engage the inner periphery of top coupling 34 above and below ports 40 to seal off ports 40 in the closed position.

Figure 2B:
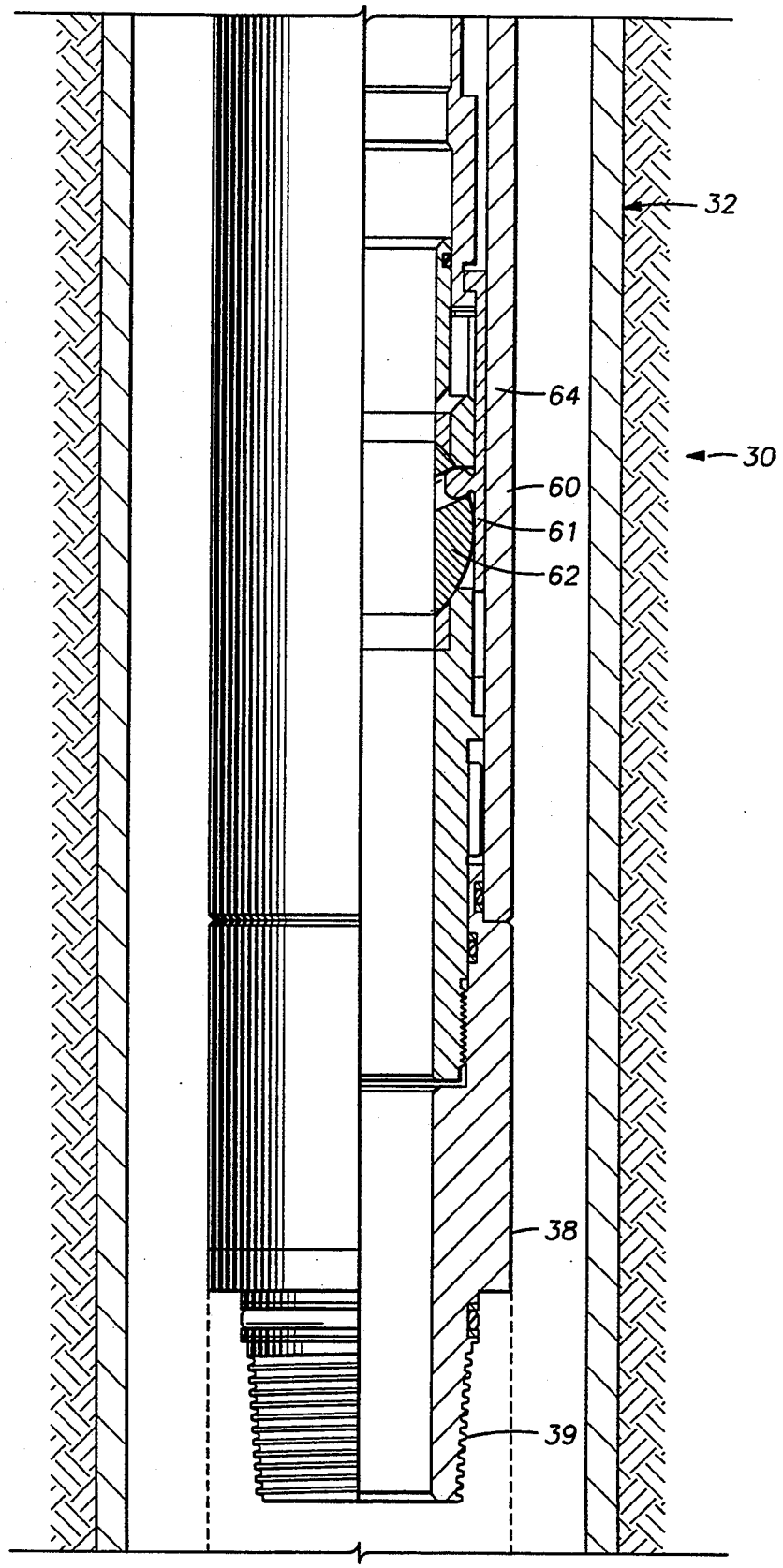

Referring briefly to FIG. 2B, closure member 60 of housing 32 is above threads 38 and preferably comprises a conventional ball valve 62 seated in a ball valve cage 64. Ball valve 62 is rotated closed by longitudinal downward motion of mandrel 70, as mandrel 70 engages spring fingers 68 mounted on an actuator 61 for rotating ball valve 62. The operation of circulating port 40 and closure member 60 in this manner is well known to those skilled in the art.

Still referring to FIG. 2, rupture member 42 of housing 32 threadingly engages top coupling 34 at 35 and closure member 60 at 65 and includes a rupture disc 44 closing a rupture port 46 through rupture member 42. Rupture disc 44 is supported in rupture port 46. A small rupture chamber 48, located radially inward of disc 44, is formed between mandrel 70 and housing 32 and is sealed by seals 49, 50 and 87. Because chamber 48 is created when the tool is assembled, the pressure in chamber 48 is essentially atmospheric. Rupture member 42 is cylindrical and has an enlarged bore portion 52 having an inner cylindrical surface 53 and a reduced bore portion 54 having an inner cylindrical surface 55. An upwardly facing annular shoulder 56 is formed by the diameter change between surface 53 and surface 55. An annular elastomeric bumper 58 is seated against annular shoulder 56.

Mandrel 70 is generally cylindrical and comprises an upper portion 72, enlarged diameter piston portion 74, a medial portion 76, and a lower engagement portion 78. Lower engagement portion 78 is adapted to engage spring fingers 68 in a conventional manner, to actuate ball valve 62. Upper portion 72 and medial portion 76 have outer cylindrical surfaces 73 and 77 respectively. The dimensions of outer cylindrical surfaces 73 and 77 are substantially the same. Surface 73 is slidingly received within the bore formed by the cylindrical inner surface 41 of the top coupling 34 and surface 77 is slidingly received within the bore formed by the cylindrical inner surface 55 of rupture member 42. Lower portion 78 has an outer cylindrical surface 83 having a diameter less than that of inner surface 55. Surface 83 includes an annular groove 84. In this manner, mandrel 70 is slidingly received within housing 32.

A downwardly facing mandrel shoulder 81 is formed between outer cylindrical surface 77 and outer cylindrical surface 83, since surface 83 has a diameter less than surface 77. A lower annular chamber 94 is formed between surfaces 55 and 83 when the tool is assembled. Before tool 30 is actuated, mandrel 70 is its uppermost position, with piston portion 74 having an annular stop shoulder 75 abutting the lower end of top coupling 34, as shown in FIG. 2. A frangible restraining means 80 is located between outer surface 73 and top coupling 34. Restraining means 80 provides a means for restraining movement of mandrel 70 in a downward direction. Restraining means 80 preferably comprises at least one shear pin 82. Below shoulder 56, in lower chamber 94, the pressure inside housing 32 is uniform with the pressure in flowbore 21.

Piston portion 74 has an outer diameter greater than the rest of mandrel 70 and thus forms an outer annular surface 78 that is in sliding contact with inner cylindrical surface 53 of rupture member 42. A downwardly facing annular shoulder 79 is formed by the diameter change between the outer surface of piston portion 74 and surface 77. An upper annular chamber 90 is formed between surfaces 53 and 77 when the tool is assembled. Upper annular chamber 90 is deemed in the radial direction by outer cylindrical surface 77 and inner cylindrical surface 53 and extends in the longitudinal direction from shoulder 79 to shoulder 56.

In a conventional tool, upper chamber 90 is sealed between surfaces 55 and 77 and contains air at atmospheric pressure. Compared to the hydrostatic and applied pressures in the well, the pressure in chamber 90 is negligible. The application of a predetermined pressure to the annulus 16 causes rupture disc 44 to rupture, with the result that a pressure differential equal to the difference between the pressure in annulus 16 and the pressure in chamber 90 is applied across piston portion 74 of mandrel 70. This pressure differential across piston portion 74 drives mandrel 70 in a downward direction, collapsing chamber 90, which acts as a cylinder. Mandrel 70 reaches its lowermost position when shoulder 79 contacts bumper 58. In the preferred embodiment, the head 69 of each inwardly biased spring finger 68 engages annular groove 84 when mandrel 70 attains its lowermost position, thereby locking mandrel 70 down. Movement of mandrel 70 results in the opening of circulating port 40, by movement of seal 85 below port 40, and also causes ball valve 62 to close. This is typically one of the last operations in a drill stem test, as the closure of ball valve 62 closes in the formation and is not readily reversible.

Prior to the start of the flow portion of the drill stem test, however, it may be desired to pressure test the equipment by applying several thousand pounds of pressure to flowbore 21. During such a test, flowbore 21 is sealed from the formation 5 by a separate closure means that is not part of the present invention and high pressure is applied at the well-head. The total pressure in flowbore 21 is then the sum of the applied pressure and the hydrostatic pressure of the fluid in flowbore 21. The total absolute pressure is applied across mandrel 70 at those points where mandrel 70 is surrounded by atmospheric pressure. In a conventional tool, chambers 90 and 48 are at atmospheric pressure. Mandrel 70 tends to deform radially into chamber 90 when flowbore 21 of the test string is subjected to high pressure test conditions, thereby rendering the tool inoperable as discussed above.

It has been found that deformation of the mandrel can be avoided by venting pressure through at least one port 92 through mandrel 70, as shown in FIG. 2, and optionally eliminating the seal between surfaces 55 and 77. According to a preferred embodiment, twelve ports 92 are provided in two rows of six ports each, but it will be understood that the number and configuration of the ports can be varied without departing from the spirit of the invention. Ports 92 are always open, allowing the pressure in upper chamber 90 to equalize with the pressure in the flowbore 21 of the test string 10. It is preferred that ports 92 be positioned adjacent to and immediately below piston portion 74 of mandrel 70, so that ports 92 are not obstructed by reduced bore portion 54 of rupture member 42 until mandrel 70 is in its lowermost position.

Unlike conventional tools, when a high pressure test is run on the present tool, there is no pressure differential across the unsupported medial portion 76 of mandrel 70. Piston portion 74, because it faces rupture chamber 48, is the only section of mandrel 70 that is subjected to the full pressure differential between the test pressure in flowbore 21 and atmospheric pressure. Piston portion 74 does not deform during high pressure testing because its area is small, its cross-section is relatively thick, and because it is mechanically supported by inner cylindrical surface 53 of rupture member 42.

Mandrel 70 is mechanically supported by upper coupling 34 above rupture chamber 48, and the pressure in chambers 90 and 94 below seal 50 is equal to pressure in flowbore 21. Thus, mandrel 70 will not deform, and will remain operable even if subjected to high pressure test conditions.

In a conventional tool, at least one O-ring seal 96 (shown in phantom) is typically positioned between surface 77 of mandrel 70 and surface 55 of rupture member 42, in order to seal upper chamber 90 from lower chamber 94. For example, it is common to place a seal immediately below bumper 58 and shoulder 56. It will be understood that, in the present apparatus, because pressures in upper chamber 90 and lower chamber 94 are equal, no seal is required. If the seal is not eliminated, however, it will serve as a barrier to the passage of material from upper chamber 90 into the region between mandrel 70 and closure member 60, or in the opposite direction. This will prevent the ingress of undesired material, such as oversized solid particles, into the region between mandrel 70 and closure member 60, and will prevent uneven flow patterns within the tool that might otherwise occur when the pressure inside the flowbore 21 of the test string 10 fluctuates.

According to a preferred embodiment, chamber 90 may be packed with a viscous fluid such as grease or similar material during assembly of the tool. Preferably, the fluid is sufficiently viscous that it will remain in chamber 90 until the tool is actuated and downward motion of mandrel 70 forces it out through ports 92. Packing chamber 90 with fluid allows the pressure in chamber 90 to equilibrate with that in flowbore 21 of the test string 10 without allowing well fluids to enter the chamber 90.

After the conclusion of any high pressure tests, the applied pressure is removed from flowbore 21, leaving only hydrostatic pressure. Pressure can then be applied to the annulus 16 to actuate the tool. The pressure in rupture chamber 48 is still atmospheric pressure. When the sum of the applied pressure and the hydrostatic pressure in the annulus reaches the predetermined rupture pressure of rupture disc 44, disc 44 will rupture. When rupture disc 44 ruptures, the pressure in rupture chamber 48 goes to annulus pressure. At this point, the force driving mandrel 70 downward into its valve closing position is the difference between annulus pressure in chamber 48 and flowbore pressure in chamber 90. This difference equals the applied pressure within the annulus 16, and is typically approximately 1,000–5,000 psi. It is this pressure difference, applied across piston portion 74 that causes mandrel 70 to slide within housing 32, which forms a cylinder therefor.

When rupture disc 44 ruptures and mandrel 70 is driven downward, the contents of chamber 90 will be forced out of chamber 90. Therefore, if ports 92 are too small, the rate of fluid flow out of chamber 90 will be too low. Significant hydraulic resistance will be created and mandrel 70 may not be able to attain its lowermost position and effect closure of ball valve 62. On the other hand, if ports 92 are too large, mandrel 70 will be weakened unnecessarily. Thus in most cases it will be preferred to provide ports 92 that are between 0.25 and 1.0 inches in diameter.

Rupture disc 44 is designed to yield at a certain predetermined pressure, so that opening of rupture port 46 may be effected in a controlled manner by deliberate application of the predetermined pressure to the well annulus 16. Rupture disc 44 also functions as a safety mechanism, as it will operate to close in the well if the pressure in annulus 16 inadvertently rises above the predetermined rupture pressure, as in the event of a tubing leak into the annulus 16.

Deformation of tool parts is a common problem when a low (atmospheric) pressure chamber is included in the body of a tool. Use of these chambers is not limited to the particular safety circulating valve discussed above. It will be understood that the present invention is useful in eliminating deformation in other tools where it is suitable to operate the tool by means of differential pressure rather that by absolute pressure. As discussed above with respect to the present tool, a small atmospheric chamber is maintained so that the tool is actuated by absolute pressure, in this case the rupture of disc 44 into rupture chamber 48, but the large unsupported area created by the presence of a large atmospheric chamber is eliminated.

Thus, the apparatus of the present invention is well adapted to attain the ends and advantages mentioned as well as those inherent therein. While presently preferred embodiments of the invention have been described for the purpose of this disclosure, changes in the construction and arrangements of parts can be made by those skilled in the art, which changes are encompassed in the scope of this invention as defined by the appended claims.

What is claimed is:

1. An apparatus for use in a well, comprising:

a housing having a central bore and a port through a wall in said housing;

said housing further including a rupture port in said wall sealed by a rupture disc;

a member slidably mounted in said housing between a first position closing said port and a second position opening said port, said member having an interior port in a wall of said member which communicates with said central bore, said member and housing forming an annular cylinder with said member having a piston member extending into said cylinder; and said rupture port communicating with said cylinder on one side of said piston member and said interior port communicating with another side of said piston whereby a pressure differential across said piston member causes said piston member to slide said member from said first position to said second position.

2. The apparatus according to claim 1 further including a closure member for closing said central bore.

3. The apparatus according to claim 1 wherein said port is adjacent said cylinder.

4. The apparatus according to claim 1 wherein said member includes twelve interior ports.

5. The apparatus according to claim 4 wherein said interior ports are evenly circumferentially spaced.

6. The apparatus according to claim 1 wherein said interior ports have a diameter between 0.25 and 1.0 inches.

7. The apparatus according to claim 1 wherein said member is driven from said first position to said second position by a difference between pressure outside the apparatus and pressure in said central bore.

8. The apparatus according to claim 1 wherein said cylinder is filled with grease.

9. The apparatus according to claim 1, further comprising a restraining means between said member and said housing.

10. The apparatus according to claim 9 wherein said restraining means comprises a shear pin.

11. The apparatus according to claim 1, further including means for locking said member in said second position.

12. An annulus pressure responsive downhole tool apparatus, comprising: a cylindrical housing having a central bore and a circulating port therethrough and including a ball valve for closing the central bore;

a concentric mandrel blocking said circulating port, said mandrel being slidably mounted such that an increase in annulus pressure causes said mandrel to move to a second position wherein said circulating port is opened and said ball valve is closed;

said mandrel defining an annular space between a cylindrical outer surface of said mandrel and a cylindrical inner surface of said housing, said mandrel having a port therethrough, said port allowing communication between said annular chamber and the interior of the apparatus.

13. An apparatus suspended on a pipe string in a well forming an annulus and a flowbore, comprising:

a housing adapted for connection in the pipe string;

a mandrel movably disposed within said housing;

said housing and said mandrel defining a pressure chamber therebetween;

means for opening said pressure chamber to the annulus upon the application of a first pressure differential between the annulus and said pressure chamber; and means for moving said mandrel in response to a second pressure differential between the annulus and the flowbore.

14. The apparatus according to claim 13, further including a circulating port through said housing, wherein said moving means causes said mandrel to move from a circulating port closed position to a circulating port open position.

15. The apparatus according to claim 14 wherein said opening means opens at a predetermined pressure differential.

* * * * *